United States Patent [19]

Brillhart

[11] Patent Number: 4,929,252

[45] Date of Patent: May 29, 1990

[54] FUEL

[76] Inventor: Donald D. Brillhart, 14713 Rockside Rd., Cleveland, Ohio 44137

[21] Appl. No.: 367,198

[22] Filed: Jun. 15, 1989

[51] Int. Cl.[5] ..... C10L 1/02

[52] U.S. Cl. ..... 44/53

[58] Field of Search ..... 44/53

[56] References Cited

U.S. PATENT DOCUMENTS 4,397,655 8/1983 Sweeney ..... 44/66

*Primary Examiner*—William R. Dixon, Jr.
*Assistant Examiner*—Rhonda R. Brown

[57] ABSTRACT

Castor oil extended by addition of an alcohol and water, the mixture then being essentially immune to phase separation or haziness or inadvertent addition of extra water contamination, of a pH range of about 4–12½ and having a flash point above the United States government regulation permitting the fuel to be shipped interstate as an oil rather than as a volatile solvent or fuel.

3 Claims, No Drawings

FUEL

BACKGROUND OF THE INVENTION

1. Field of the Invention

Non-hydrocarbon fuels, especially for internal combustion engines, but useful for heating combustion also.

2. Description of Prior Art

It has been said that a diesel engine can be operated on any carbonateous structure that can be liquified, or even a dust such as coal powder but as a practical matter there are some fuels which are far better in a diesel engine than extreme examples such as peanut oil.

It is well recognized that in the present world economy, fossil fuels are far less expensive when processed into a useful fuel than vegetable oils of any kind. Nevertheless, development of farm produced, renewable vegetable oil fuels is proceeding on many levels against that day when fossil fuel is exhausted or politically excluded from international trade.

Probably one of the better concise background prior art studies is found in U.S. Pat. No. 4,397,655, inventor William M. Sweeney and assigned to Texaco, Inc. of Whiteplaints, N.Y.

The teaching of the prior patent recognizes that vegetable oil may be extended by the addition of ethanol, but when so extended, is vulnerable to water contamination and phase separation or haziness.

The referenced patent is ingenious in handling the water contamination process by the expedient of a catalytic reaction of the water with a ketal in the presence of an acid environment which acts as the catalyst. This is the reason for an acid medium. This procedure simply catalyzes any water into alcohol, thereby eliminating the water problem and producing a useful fuel. Acetal or orthoester are alternative reactants.

OBJECTS

To provide a diesel and general fuel from a vegetable source.

Another object of this invention is to provide a true solution vegetable fuel with water content as a component.

Still another object of this invention is to provide a fuel of a vegetable oil and commercial grade alcohol with about 4.4 wt % or 10.57 mol % water, having no adverse effect from the water, and in fact having benefits of water injection.

Another object of this invention is to provide a diesel fuel from vegetable and alcohol sources in a wide range of acid/base tolerance.

It is a further object of this invention to avoid oil and alcohol emulsion separation problems of the prior art, by bonding castor oil which has hydroxyl moietie, to the water component of ethyl alcohol and water azeotrope.

Another object of this invention is to blend azeotropic alcohol-water with castor oil in a stable solution susceptible to small additions of corrosion inhibitor.

Another object of this invention is to provide a castor oil and azeotropic alcohol/water with rust and corrosion inhibition without regard to pH range caused thereby.

Another object of this invention is to provide an azeotrope water-to-alcohol in solution with castor oil, and tolerant of ph range from 4–12½.

Another object of this invention is to provide a three-way true solution of castor oil, alcohol, and water that is compatible with corrosion inhibition such as benzotriazol, amines, etc.

Another object of this invention is to provide a castor oil based diesel fuel which will operate at lower exhaust gases temperature as compared to #2 commercial diesel fuel, thereby favoring low oxides of nitrogen, sulphur, and carbon or carbon polymers; to bring about cleaner air.

Another object of this invention is to provide a fuel (diesel or general) which is free of sulfer, thereby giving less acidic rain.

An important object of the invention is to provide a diesel fuel having a flash point high enough to permit shipment as oil.

The foregoing has outlined some of the more pertinent objects of the present invention. These objects should be construed to be merely illustrative of some of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims.

DESCRIPTION OF THE PREFERRED EMBODIMENT

This invention is primarily concerned with the use of castor oil as the natural vegetable oil base for a high British thermal units fuel. The prior art reference (supra) does list in a table a number of oils, including castor, which have been made useful by the said prior art process. However, castor oil is classified and processed in the same manner as the balance of the various oils which include soy, corn, olive and coconut oils among others. Castor oil has a unique characteristic which is the basis for its selection in this invention. That unique feature is the presence of OH groups which will bind water, probably through hydrogen bonding. Thus, the said prior art process is counter productive for castor oil.

Castor oil may be extended with absolute ethanol, methanol, ether, chloroform and glacial acetic acid. Obviously, the only practical extenders in this list are the ethanol and methanol. Merck Index, Tenth Edition, specifies that castor oil is miscible with absolute ethanol. Absolute ethanol is water-free. However, absolute ethanol is very expensive to produce and maintain and therefore further removes the use of vegetable oil from practical application.

This invention is in the discovery that the distilled commercially available azeotropic ethanol ideally compliments the hydroxyl moiety of castor oil when blended at about 73% castor oil to 20 or 25% of the azeotrope. In this ratio, it has been found that the fuel is stable, clear, with a flash point above that of number 2 diesel oil. Most importantly, the water is bonded to the hydroxyl moieties of the oil in such a way that the final product is enhanced by the water and does not subdue ignition or actively cause severe corrosion.

In fact, at the preferred ratio of 75–25 the fuel is compatible with steel and copper corrosion inhibiters such as ammonia derivatives and benzotriazol, etc. Some inhibitors will cause the fuel to deviate from the ideal, non-corrosive, neutral pH 7. The oil and alcohol are essentially neutral pH 7, but will tolerate additives which change the pH. The prior art (supra) requires acidic media.

For a better understanding of the invention, castor oil is essentially the following structural formula:

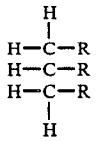

where R is the Ricinoleic fatty acid anion as:

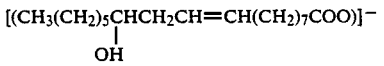

from Ricinoleic acid as $HOC_{17}H_{32}COOH$ or 12 hydroxy oleic acid.

It is submitted that this invention has been proven in actual practice and used in a diesel automobile engine without any modification of that engine. Therefor, although it is believed that hydrogen bonding is responsible for rendering the water of the azeotropic alcohol harmless, the invention is based on reduction to practice and not on chemical theory.

Although the flash point of the fuel is above that of number 2 diesel and passes the specification for shipping interstate as oil, the flash point has virtually nothing to contribute to the usefulness of the fuel because the fuel is injected into freshly compressed hot air which may run as high as about 1,000° F., at 500 pounds more or less per square inch of pressure. All organic carbon compounds (carbon bonds) thermally decompose at or below about 700° F. (371)°C. and therefor the flash point of the inventive fuel is of little importance in this environment, and also will be readily ignited by a flame or pilot light for combustion heating purposes.

DETAILED DISCUSSION

Experimental diesel engines have been built and tested on almost any hydrocarbon imaginable and have been able to operate. None, however, has operated satisfactorily to serve as a commercial engine with commercially available fuels. The test machines remain just test machines and curiosities.

Likewise, pure castor oil can be burned in a modified engine to produce useful power. The engines that are available at the time of this invention, which are useful commercially with hydrocarbon diesel fuel will not accept pure castor oil for satisfactory commercial use. The viscosity of the oil resists proper feed and dispersion to or in the swirl chamber of the currently available engine. The prior art refers to extenders for use with oils, and that term is usually associated with making something less expensive by the addition of a cheaper additive. The present invention uses azeotropic ethyl alcohol (ethanol) as its preferable ingredient, but is used to produce a viscosity that is more suitable for commercial diesel engines designed for hydrocarbon fuels. That goal would appear to be easily obtained except that with most vegetable oils available, the alcohol, as stated in the prior art patents, must be anhydrous because the addition of the 5% more or less of water in azeotropic alcohol is incompatible because of phase separation and corrosion and ignition problems.

The present invention teaches the bonding of the natural azeotropic percentage of water in the ethanol, a fuel itself and a viscosity modifier with the elimination of the problems enumerated in the prior art.

The preferred embodiment comprises, by weight, about 75% castor oil, and the balance of azeotropic ethanol containing about 96% alcohol and 4% water.

This preferred embodiment of the invented fuel has been engine tested and it has been found that greater percentages of ethanol reduce the engine performance from the optimum, and that lesser percentages likewise reduce the performance the fuel system and of the engine. Hence, although greater or lesser amounts than 75–25 ratio of oil to alcohol will operate, the optimum is at or near those percentages.

At the preferred percentage ratios, the fuel is found to have a low vapor pressure that materially reduces atmospheric contamination by evaporation, and to have a lower exhaust temperature in the engine system as compared to hydrocarbon fuels.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention, and its potential benefit to civilization.

What is claimed is:

1. A method of making a fuel suitable for diesel engine use, comprising the blending of castor oil and an azeotrope of ethyl alcohol and water.

2. A method of making a fuel suitable for diesel engine use, comprising the blending of castor oil and an azeotrope of ethyl alcohol and water, the castor oil being the major ingredient.

3. A method of making a fuel suitable for diesel engine use, comprising the blending of castor oil and an azeotrope of ethyl alcohol and water, the castor oil being about 75 percent and the balance essentially the azeotrope.

* * * * *